US010890083B2

(12) United States Patent
Rowe et al.

(10) Patent No.: US 10,890,083 B2
(45) Date of Patent: Jan. 12, 2021

(54) TURBINE TIP CLEARANCE

(71) Applicant: ROLLS-ROYCE plc, London (GB)

(72) Inventors: Arthur Laurence Rowe, Derby (GB); Marko Bacic, Oxford (GB)

(73) Assignee: ROLLS-ROYCE plc, London (GB)

( * ) Notice: Subject to any disclaimer, the term of this patent is extended or adjusted under 35 U.S.C. 154(b) by 872 days.

(21) Appl. No.: 15/133,883

(22) Filed: Apr. 20, 2016

(65) Prior Publication Data

US 2016/0326901 A1 Nov. 10, 2016

(30) Foreign Application Priority Data

May 8, 2015 (GB) ..... 1507881.9

(51) Int. Cl.
*F01D 11/24* (2006.01)
*F01D 21/12* (2006.01)
*F01D 21/14* (2006.01)

(52) U.S. Cl.
CPC ..... *F01D 11/24* (2013.01); *F01D 21/12* (2013.01); *F01D 21/14* (2013.01); *F05D 2270/021* (2013.01); *F05D 2270/112* (2013.01); *F05D 2270/303* (2013.01); *F05D 2270/304* (2013.01); *F05D 2270/705* (2013.01)

(58) Field of Classification Search
CPC ..... F01D 11/14; F01D 11/20; F01D 11/24; F05D 2270/303; F05D 2270/304
See application file for complete search history.

(56) References Cited

U.S. PATENT DOCUMENTS 5,081,830 A * 1/1992 Schwarz ..... F02C 9/16 60/782
5,174,105 A * 12/1992 Hines ..... F02C 3/10 60/774
7,431,557 B2 * 10/2008 Herron ..... F01D 11/24 415/1
2006/0196164 A1 * 9/2006 Donohue ..... F01D 5/147 60/226.1
2008/0069683 A1 3/2008 Nigmatulin et al.
(Continued)

FOREIGN PATENT DOCUMENTS

EP 1860281 A2 11/2007
EP 2604806 A2 6/2013
(Continued)

OTHER PUBLICATIONS

Oct. 30, 2015 Search Report issued in British Patent Application No. 1507881.9.
(Continued)

*Primary Examiner* — Ninh H. Nguyen
*Assistant Examiner* — Cameron A Corday
(74) *Attorney, Agent, or Firm* — Oliff PLC

(57) ABSTRACT

A method of controlling turbine tip clearance includes measuring turbine speed; measuring turbine temperature; measuring parameters indicative of current operating conditions; determining limits for the turbine speed and turbine temperature; calculating target tip clearance from the turbine speed, turbine temperature and parameters, to optimise turbine efficiency within the turbine speed and turbine temperature limits; and controlling turbine tip clearance apparatus to the calculated target tip clearance.

21 Claims, 7 Drawing Sheets

(56) References Cited

U.S. PATENT DOCUMENTS

| | | | | |
|---|---|---|---|---|
| 2010/0303612 | A1 | 12/2010 | Bhatnagar et al. | |
| 2013/0152601 | A1* | 6/2013 | Bacic ..... | F01D 11/24<br>60/782 |
| 2015/0247417 | A1* | 9/2015 | Bacic ..... | F01D 21/14<br>415/1 |

FOREIGN PATENT DOCUMENTS

| | | | |
|---|---|---|---|
| EP | 2843198 | A1 | 3/2015 |
| GB | 2218224 | A | 11/1989 |
| GB | 2460948 | A | 12/2009 |
| RU | 2546381 | C1 | 4/2015 |

OTHER PUBLICATIONS

Sep. 21, 2016 Search Report issued in European Patent Application No. 16166109.

* cited by examiner

TURBINE TIP CLEARANCE

The present disclosure concerns a method of controlling turbine tip clearance and a corresponding turbine tip clearance system.

In a gas turbine engine there are various rotary components, including compressor stages and turbine stages. Each of these stages comprises a hub and an array of blades extending radially away from the hub. The blades each have a root portion at the hub, an aerofoil portion having pressure and suction sides, and a tip at the distal end to the hub. The array of blades is surrounded by a casing which is static. A clearance is required so that neither the blade tips nor the casing is eroded by tip rub from contact between them. Nevertheless, it is beneficial that the clearance between the tips of the blades and the casing is minimised so that all the working fluid, for example air, passes over the aerofoil portions and does useful work rather than leaking over the tips.

An initial tip clearance can be designed. However, during use of a gas turbine engine the blades and casing expand and contract at different rates to each other, due to thermal and centrifugal loading, and so the tip clearance changes. Typically the tip clearance of the turbines at take-off of an aircraft powered by one or more gas turbine engines is large, because the engine is relatively cool, and the tip clearance reduces at subsequent flight conditions, such as climb and cruise.

Turbine tip clearance systems are known to modulate the tip clearance of turbine rotors to reduce the gap to a safe minimum to improve turbine efficiency without threatening tip rub. Active and passive turbine tip clearance systems are known and may comprise, for example, cool air blown towards the casing to arrest its growth or shrink it radially and thereby reduce the radial distance between the blade tips and the casing.

According to a first aspect of the invention there is provided a method of controlling turbine tip clearance comprising steps to:

- measure turbine speed;
- measure turbine temperature;
- measure parameters indicative of current operating conditions;
- determine limits for turbine speed and turbine temperature;
- calculate target tip clearance from the turbine speed, turbine temperature and parameters, to optimise turbine efficiency within the turbine speed and turbine temperature limits; and
- control turbine tip clearance apparatus to the calculated target tip clearance.

Advantageously the method enables the turbine speed and turbine temperature to be managed so that the available margins for both speed and temperature run out at the same time. In particular the turbine tip clearance can be used to trade between the turbine temperature and the turbine speed.

The steps of measuring the turbine speed, measuring the turbine temperature, measuring the parameters, and determining the speed and temperature limits may be performed in any order.

The turbine speed may be measured once per flight or may be measured once every n flights. The turbine speed may comprise the peak turbine speed. The turbine temperature may be measured once per flight or may be measured once every n flights. The turbine temperature may comprise the peak turbine temperature. The engine deterioration which reduces the available margin for turbine speed and turbine temperature occurs over a relatively long period of operation so it is not necessary to measure turbine speed or temperature frequently. The measured turbine speed and turbine temperature may be used to calculate the offset to the target tip clearance for the next flight or flights. Advantageously the calculation therefore has a different iteration rate to the main turbine tip clearance control loop so the dynamics of each loop do not adversely interact. Advantageously taking fewer measurements reduces the processing power required. Advantageously the sensors for measuring the turbine speed and/or turbine temperature may be extant sensors. The measurements may also be used for other purposes within the engine control and/or monitoring.

The parameters may comprise engine power level. The parameters may comprise flight condition. The parameters may comprise altitude and/or throttle position.

The step to calculate target tip clearance may comprise using a proportional-integral algorithm. Advantageously this provides closed loop control of the tip clearance and therefore minimises the requirement for accurate data tuning on initialisation or subsequently.

The step to calculate target tip clearance may comprise an input that is the difference between the current measured tip clearance and the calculated target tip clearance. This is an offset.

The step to measure turbine temperature may comprise measuring one or more engine parameters and deriving turbine temperature therefrom. The engine parameters may include compressor delivery temperature; compressor delivery pressure; fuel flow rate; nozzle guide vane area. Advantageously the method is also applicable to turbines where the temperature is too high to measure directly, or for which it is more convenient to measure different engine parameters and to derive the turbine temperature.

According to a second aspect of the invention there is a turbine tip clearance system comprising:

- one or more sensors to measure turbine speed, turbine temperature, and parameters indicative of current operating conditions;
- a processor configured to receive measurements from the sensors; perform steps of the method according to the first aspect; and to output a turbine tip clearance signal; and
- an actuator configured to receive the turbine tip clearance signal and to actuate turbine tip clearance apparatus to change the tip clearance to match the calculated target tip clearance.

Advantageously the system enables better management of turbine speed and temperature margins. Advantageously the system also enables the turbine efficiency to maintained within the limit constraints.

According to a third aspect of the invention there is a turbine assembly comprising the turbine tip clearance system of the second aspect.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Embodiments will now be described by way of example only, with reference to the Figures, in which.

Figure 1:
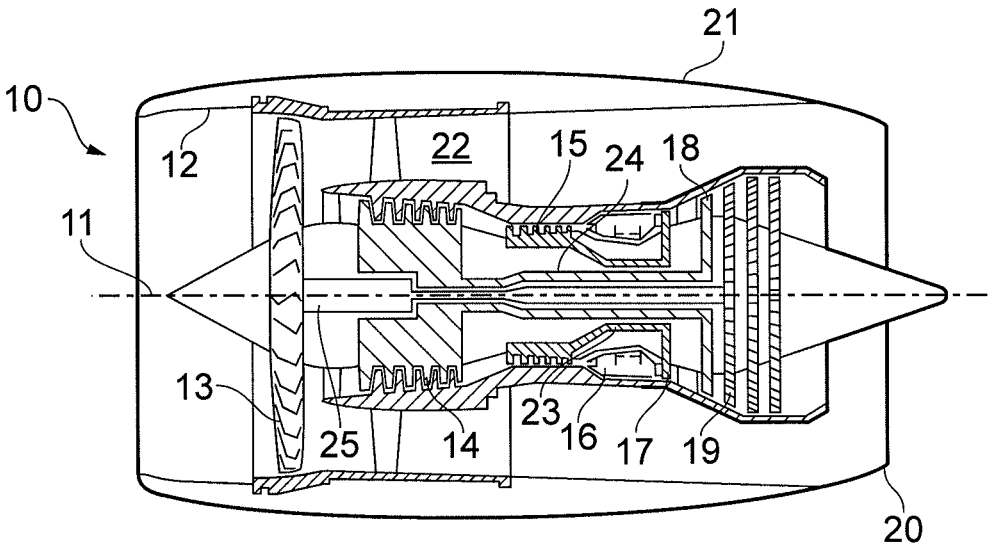
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft 23, 24, 25.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

For the present disclosure the gas turbine engine 10 is assumed to power an aircraft, either singly or with one or more identical engines.

Figure 2:
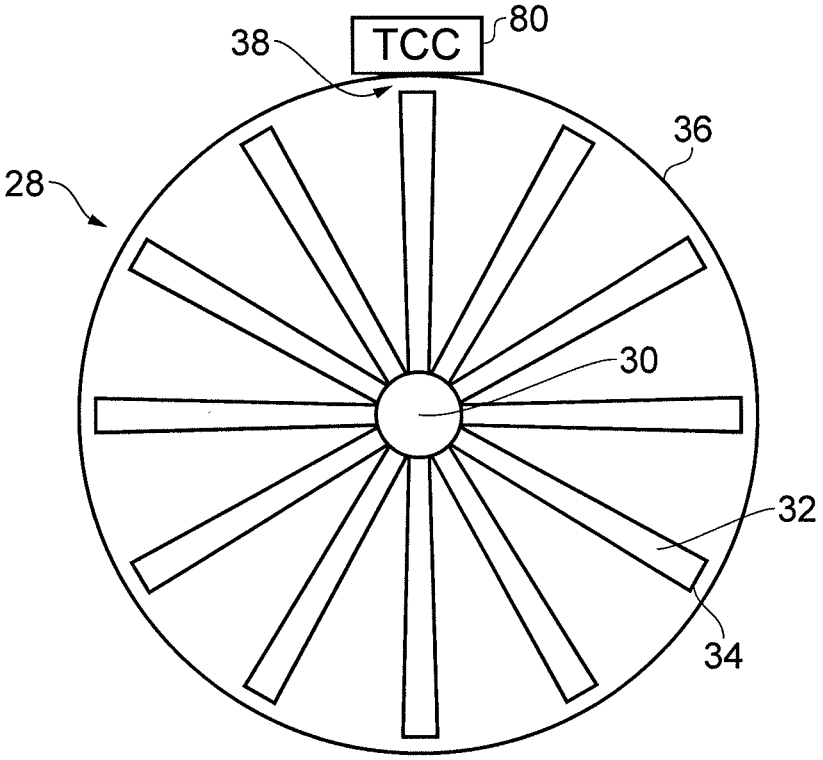
FIG. 2 is a schematic illustration of a rotor stage of a gas turbine engine.

Each of the fan 13, intermediate pressure compressor 14, high pressure compressor 15, high pressure turbine 17, intermediate pressure turbine 18 and low pressure turbine 19 comprises one or more rotor stages. A schematic illustration of a rotor stage 28 is shown in FIG. 2 comprising a rotor hub 30, in the form of a disc, from which radiate a plurality of blades 32. The blades 32 each comprise a blade tip 34 at the radially distal end from the hub 30. Radially outside the blade tips 34 is a rotor stage casing 36 which may include a segment assembly comprising a plurality of segments forming its radially inner surface as will be understood by those skilled in the art. Between the blade tips 34 and the rotor stage casing 36 is a clearance 38. The rotor stage casing 36 optionally has a segment assembly on its radially inner surface. The segment assembly may be comprised of a plurality of discontinuous segments in a circumferential array. The segments may be actively or passively controlled to move radially inwardly or outwardly to change the clearance 38 between them and the blade tips 34.

In use of the gas turbine engine 10, working fluid (air) does work on the rotor blades 32 as it passes substantially axially through the engine 10. Working fluid that passes over the blade tips 34 through the clearance 38 does no useful work and therefore reduces the efficiency of the engine 10 and increases fuel consumption. However, the clearance 38 is necessary to prevent the blade tips 34 rubbing against the rotor stage casing 36 which causes damage to one or both components. Tip rub is a transient effect because the rub erodes the blade tip 34 or casing surface which results in the clearance 38 being increased and therefore the engine efficiency reducing.

Additionally the clearance 38 is not constant throughout use of the gas turbine engine 10. Taking the example of a gas turbine engine 10 used to power an aircraft, the rotor stage 28 components grow and shrink in response to centrifugal forces and temperature changes resulting from different engine operating conditions. Thus when the engine 10 is cold, before use, the rotor blades 32 have a defined radial length and the rotor stage casing 36 has a defined diameter and is annular. The components each grow or shrink by different amounts and with a different time constant governing the speed at which the growth or shrinkage occurs. The growth due to centrifugal forces is substantially instantaneous.

When the engine 10 is switched on it begins to heat up and the rotor hub 30 and blades 32 begin to rotate which causes all the rotating components to grow radially. Due to the rotation of the rotor blades 32 and their relatively small mass the rotor blades 32 tend to grow radially very quickly, substantially instantly, by a small amount. The hub 30 grows radially outwardly by a relatively large amount, for example three times as much as the rotor blades 32, with a long time constant, for example 100 seconds. The rotor stage casing 36 which is relatively massive and does not rotate grows by a relatively large amount, for example three times as much as the rotor blades 32, but with a long time constant, for example 50 seconds. The segment assembly grows by a small amount, for example a third of the growth experienced by the rotor blades 32, with a moderate time constant, for example 15 seconds.

During engine acceleration the rotor stage casing 36 and hub 30 grow radially outwardly and the rotor blades 32 elongate radially. The segment assembly may grow radially inwardly. The net effect is that the clearance 38 increases during engine acceleration phases of the flight such as ramp up and the start of take-off because the growth of the casing 36 is larger and quicker than the growth of the other components. Similarly, the clearance 38 decreases during engine deceleration phases because the casing 36 contracts more quickly than the hub 30. There is a settling period after an engine acceleration or deceleration during which the clearance 38 may fluctuate before settling to a steady-state clearance 38.

It is known to apply active or passive tip clearance control arrangements to reduce the variation of clearance 38. For example cool air can be selectively delivered to passages in the rotor stage casing 36 to cool the rotor stage casing 36 and thereby reduce the diameter or retard the growth of the diameter. Alternatively the segment assembly radially inside the rotor stage casing 36 can be moved mechanically to change the clearance 38.

Turbine temperature TGT is the temperature of the gas that enters the low pressure turbine 19. The temperature TET of the high pressure turbine 17 exhibits a similar profile but is lagged in time. TET may be calculated from other engine parameters including a temperature measured in a cooler part of the engine 10, for example the temperature T30 (sometimes called T3) and pressure P30 (sometimes called P3) of the compressor delivery air where it is delivered from the high pressure compressor 15 into the combustor 16, the fuel flow $W_f$ and the area of the nozzle guide vanes for that turbine 17. Although turbine temperature TGT is used herein it will be understood that the temperature at the entry to the high pressure or intermediate pressure turbines 17, 18 may be used instead.

Figure 3:
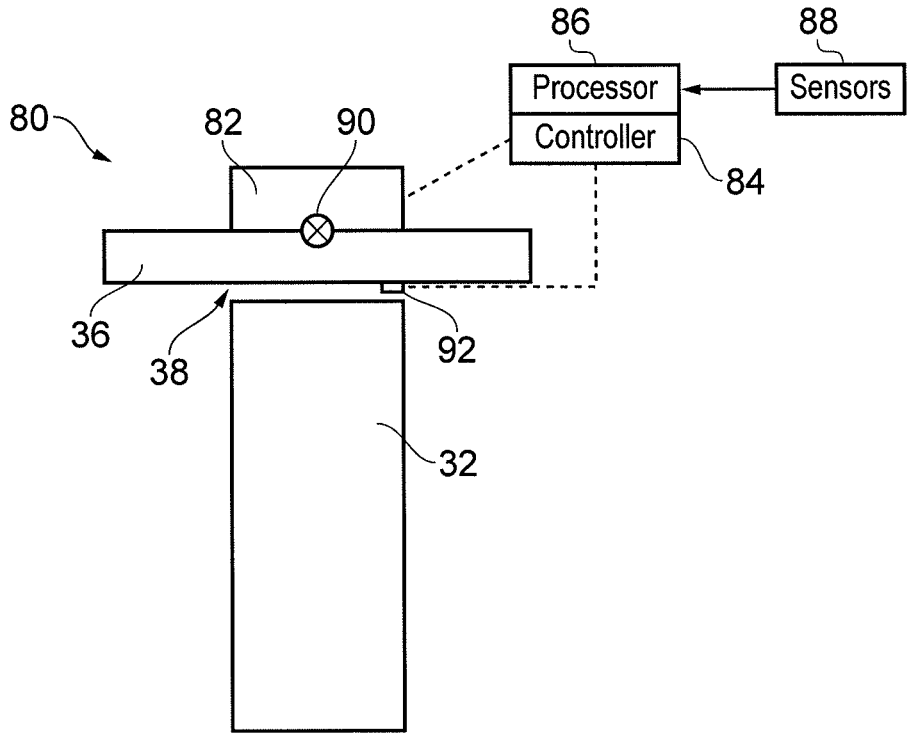
FIG. 3 is a schematic illustration of a turbine tip clearance arrangement.

A turbine case cooling system 80 is generally indicated in FIG. 2 and in more detail in FIG. 3.

A turbine tip clearance system 80 is shown in FIG. 3 and may include one or more actuators 82. The actuator or actuators 82 are arranged or configured to move the turbine casing 36 towards or away from the tips 34 of the turbine blades 32 in order to change the clearance 38. The actuators 82 may move the turbine casing 36 directly or may act indirectly, for example by opening or closing a turbine tip clearance valve 90 to change the amount of control air delivered to the turbine casing 36. Optionally a turbine case cooling sensor 92 may be provided to measure the clearance 38 directly. Alternatively the clearance 38 may be derived from the movement of the actuators 82 and a model of the expected thermal and centrifugal growth of the components. The turbine tip clearance system 80 includes a controller 84. The controller 84 receives the calculated or measured turbine tip clearance and provides a control signal to the actuator or actuators 82 to change the position of the turbine casing 36 in order to meet the calculated turbine tip clearance. Where there is more than one actuator 82 they are each controlled in common by controller 84.

The turbine tip clearance system 80 may deliver cool air to shrink the turbine casing 36 in some engine operating phases. It may also or alternatively be arranged to deliver relatively hot air to the turbine casing 36 in order to cause it to expand more rapidly. This is particularly important during rapid but transient acceleration phases of engine operation where the rotor blades 32 and hub 30 of the high pressure turbine 17 may grow more quickly than the turbine casing 36. The turbine tip clearance valve 90 is actuated to open or close in order to deliver control air to the casing 36 or to prevent control air from reaching the casing 36. The turbine tip clearance valve 90 may be bi-stable so that it is either open or closed. Alternatively it may have more than one open position or be continuously variable to direct controllable amounts of air to the turbine casing 36. The turbine case cooling valve 90 may be arranged to always deliver a small flow. Thus there is no closed position but instead is a minimum flow position and one or more positions providing more cooling flow. There may be more than one turbine tip clearance valve 90, which preferably are mutually controlled to act in concert.

The turbine tip clearance system 80 includes a processor 86 which performs steps of the method 54, which is described below. The processor 86 may be common with the controller 84, or may be coupled thereto. A memory may be a part of the processor 86 or may be operatively coupled to the processor 86. The processor 86 is coupled to one or more sensors 88 from which the measurements used in the method 54 are obtained. Thus there is one or more sensor 88 which measures the rotational speed $N_H$ of the high pressure shaft 23. There is also one or more sensor 88 which measures the turbine temperature TGT. There may also be one or more sensors 88 which measure the compressor delivery temperature T30, compressor delivery pressure P30, fuel flow $W_f$ and nozzle guide vane area A. These are engine parameters from which turbine temperature TGT may be calculated. There is also one or more sensor 88 which measures parameters indicative of flight conditions and engine power level.

The turbine tip clearance system 80 may be part of a turbine assembly. The turbine assembly may comprise one or more rotor stages 28 each having a hub 30 and an array of blades 32 radiating therefrom, a turbine casing 36 radially outside the tips 34 of the rotor blades 32, and the turbine tip clearance system 80.

Figure 4:
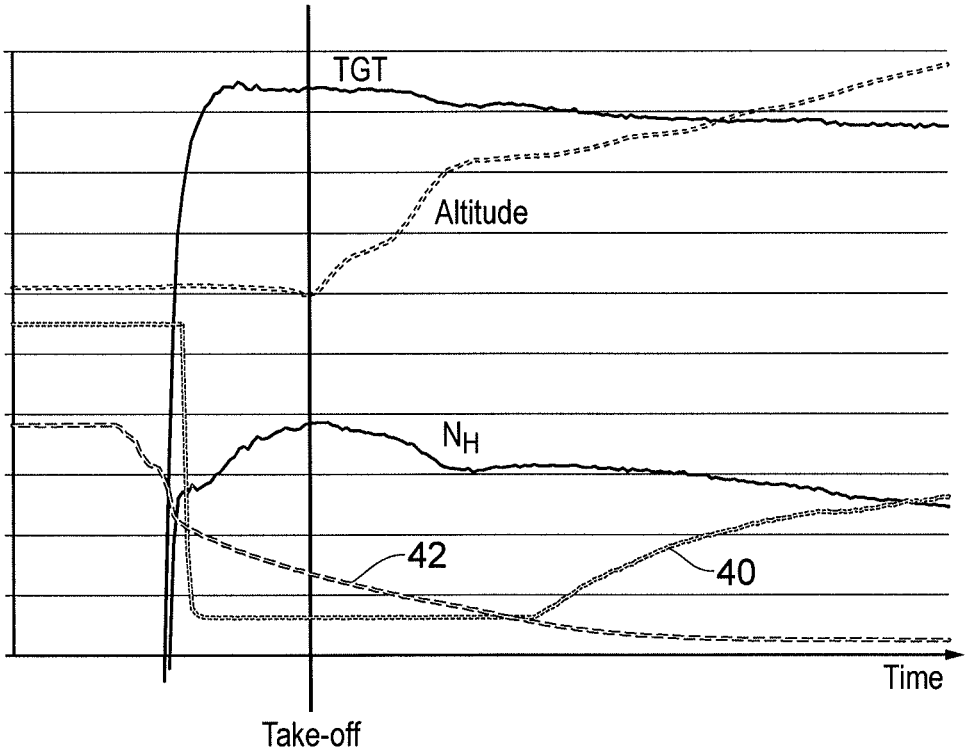
FIG. 4 is a graph of engine parameters during take-off.

In the graph shown in FIG. 4 various engine parameters are plotted against time. Altitude of the aircraft is also plotted. The time at which the altitude line begins to rise is the point at which the aircraft leaves the ground. Take-off is considered to continue for a short time beyond this, before the aircraft begins to climb, typically from about 1500 feet (457 metres). Prior to take-off the gas turbine engine 10 is cranked to start it and is run at ground idle, which is a self-sustaining condition where the aircraft is on the ground and in which the engine 10 is operating at or above all its minimum limits. Take-off encompasses the engine operation as it accelerates from ground idle speeds until it reaches the altitude defined for climb.

The high pressure shaft 23 couples the high pressure turbine 17 and the high pressure compressor 15. They rotate at a common high pressure speed, $N_H$, which is quicker than the intermediate pressure shaft 24 or the low pressure shaft 25. This high pressure speed $N_H$ increases rapidly from ground idle to take-off of the aircraft. As can be seen in FIG. 4, there is an overshoot of high pressure speed $N_H$ which peaks around the time marked take-off, which is where the aircraft leaves the ground. The high pressure speed $N_H$ then decreases and levels off.

Similarly the low pressure turbine temperature, TGT, increases rapidly from ground idle to take-off of the aircraft. It also exhibits an overshoot, albeit small in the example illustrated, which straddles the time marked take-off and then reduces to a steady value.

At the beginning of take-off the turbine tip clearance valve 90 is at its minimum flow position so minimal, or no, control air is delivered to the turbine casing 36. This is because the cold build tip clearance is sufficient that no tip rub will occur during the start or ground idle phases of engine operation. At a predefined time during take-off the valve 90 is opened so that cool air is delivered to the turbine casing 36, which can be seen by the line 40 on FIG. 4. The valve 90 may be opened in response to an elapsed time or to an event or under closed loop control.

The actual tip clearance 38 is initially the cold build clearance. As the engine 10 accelerates from ground idle the high pressure turbine 17 and turbine casing 36 grow radially due to thermal and centrifugal loading. In the absence of clearance control the tip clearance 38 initially decreases during acceleration (due to centrifugal growth) and then increases because the casing 36 grows thermally more quickly than the hub 30 and blades 32. The turbine tip clearance valve 90 may be opened when a threshold is reached, for example when the turbine speed $N_H$ has increased to a predetermined level. Alternatively the turbine case cooling valve 90 may be subject to closed loop control such that the actual tip clearance, whether measured or calculated, is one of the inputs to the control of the turbine case cooling valve 90. The control may include a predictive element which uses models of the component growths to predict how the tip clearance 38 will change in a defined time horizon and then control the turbine case cooling valve 90 to alter that predicted behaviour.

The actual tip clearance 42 may generally be considered to be the minimum tip clearance measured to the tips 34 of the rotor blades 32, which therefore accommodates any non-concentricity between the rotor blade tips and the turbine casing 36. Due to the cooling air flow provided by the opening of the turbine case cooling valve 90, line 40, the growth of the casing 36 is arrested or slowed. The hub 30 generally has a slower time constant for its growth and so it continues to grow radially so that the blade tips 34 are moved radially outwardly. As a consequence the tip clearance reduces, as can be seen from line 42 in FIG. 4.

Once the turbine tip clearance valve 90 has been opened the actual tip clearance 42 continues to reduce but the rate of decrease slows. At the point where the actual tip clearance 42 begins to level off the turbine tip clearance valve 90 may be partially and/or progressively closed to reduce the amount of control air that it delivers to the high pressure turbine 17. This is shown in FIG. 4 where the line 40 begins to rise. The actual tip clearance 42 levels off because the growth of the turbine components plateaus once the high pressure speed $N_H$ plateaus and so less cooling air is required to maintain the same clearance 38.

By tightly controlling the actual tip clearance 42 using the turbine tip clearance valve 90 the high pressure turbine 17 is efficient during take-off. Known turbine tip clearance systems seek to optimise the efficiency n of the high pressure turbine 17 by controlling the actual tip clearance 42. However, controlling the actual tip clearance 42 to optimise the turbine efficiency n causes the relatively large overshoot of the turbine speed $N_H$, and reduction of the turbine temperature TGT overshoot, during take-off. This is illustrated in FIG. 4 in which the turbine temperature TGT overshoot is modest but the turbine speed $N_H$ overshoot is relatively large, for example 1-2% of the steady state value. Both the turbine speed $N_H$ and turbine temperature TGT take a relatively long time to settle to their steady state values from the peak overshoot. As a consequence of the elevated turbine temperature TGT the turbine components are thermally degraded more quickly than is necessary for the take-off operation. Thus the life of the components is reduced leading to earlier and more frequent maintenance requirements.

As a consequence of the elevated turbine speed $N_H$ the components are exposed to higher centrifugal loading which can have a detrimental effect on rotor disc life. The high pressure compressor 15 which is coupled to the high pressure turbine 17 via the high pressure shaft 23 also rotates more quickly and therefore the speed ratio between the high pressure compressor 15 and the intermediate pressure compressor 14, and/or between the high pressure compressor 15 and the combustor 16, may be off-design and therefore less efficient than is achievable at lower speed. In addition, certification requirements set limits on the turbine temperature TGT and turbine speed $N_H$ which are permissible.

The method herein seeks to sacrifice a small amount of turbine efficiency q in favour of maintaining both turbine speed $N_H$ and turbine temperature TGT below acceptable limits. Advantageously the method may be applied only where the engine 10 is operating close to either or both of the limits during take-off. Where the operation is away from both limits the method may be omitted.

Figure 5:
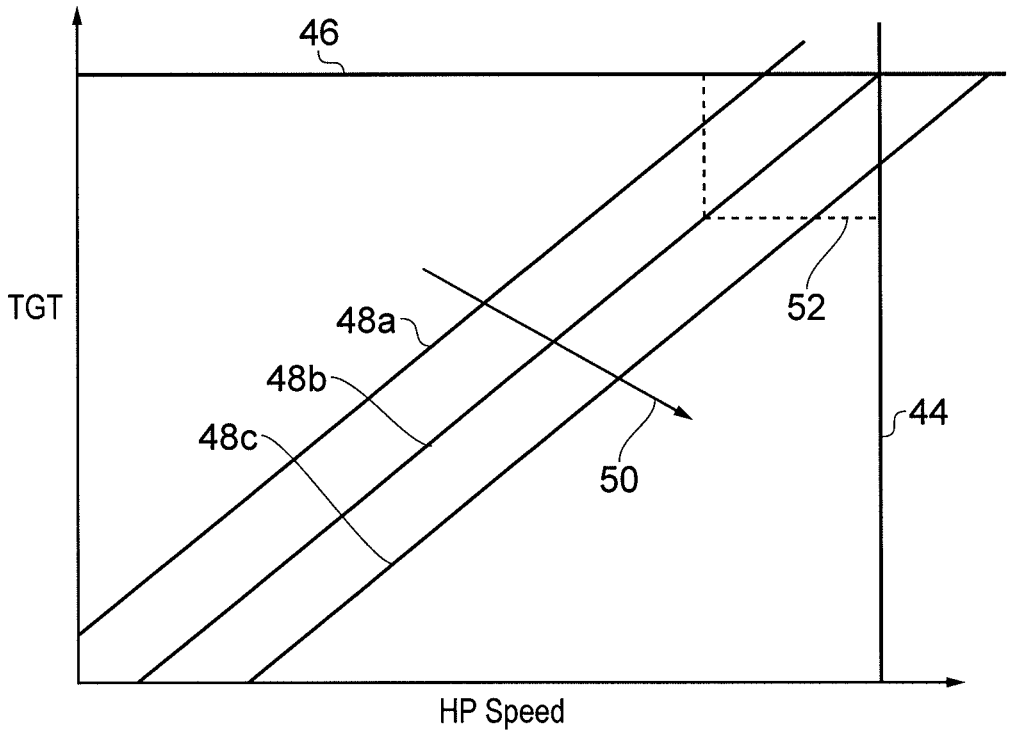
FIG. 5 is a plot of turbine temperature against turbine speed.

FIG. 5 is a plot of turbine temperature TGT against turbine speed $N_H$. A vertical line 44 indicates the turbine speed $N_H$ limit; that is the maximum permissible speed. A horizontal line 46 indicates the turbine temperature TGT limit; that is the maximum permissible temperature. The TGT limit 46 and the $N_H$ limit 44 may each be hard limits or soft limits. A hard limit is one which cannot be exceeded, either due to detrimental physical effects or due to certification requirements. A soft limit is one which can be exceeded in an emergency but it is recommended is not exceeded in normal operation. Exceeding a soft limit may cause an alarm or warning message to be generated and may provoke a requirement for earlier maintenance activity than is otherwise scheduled.

The relationship between turbine speed $N_H$ and turbine temperature TGT is fixed by the physical design of the engine 10. The high pressure turbine 17 operates at a fixed $N_H/\sqrt{TGT}$ ratio. However, during take-off transient effects such as changes in the air system flows, compressor and turbine capacities, and the efficiencies of the compressors and turbines can shift the matching between the turbine speed $N_H$ and the turbine temperature TGT. The lines 48 show a set of the turbine speed $N_H$ and turbine temperate TGT matching options during take-off. The arrow 50 indicates the progression between the lines 48 which results in increasing turbine efficiency η. Thus line 48*a* represents a less efficient operation of the high pressure turbine 17 than line 48*c* because it has a lower turbine speed $N_H$ for a given turbine temperature TGT, or because it operates at a higher turbine temperature TGT for a given turbine speed $N_H$.

Control area 52 is the part of the engine operation where the high pressure turbine 17 is close to either or both of the $N_H$ limit 44 and TGT limit 46. Optionally the method is applied only when it is detected that the high pressure turbine 17 is operating within control area 52. Alternatively, the method may be applied during all take-off operations but may include suitable filters so that the effect is only apparent close to the limits 44, 46. There is also a reduction in compressor delivery temperature T30 when the turbine efficiency q is reduced by reducing the turbine speed $N_H$. Thus it may be beneficial to operate the method during all take-offs.

Over time the high pressure turbine 17 operation moves from relatively low turbine speed $N_H$ and turbine temperature TGT during take-off, towards the origin of FIG. 5, to faster and hotter running as the engine components deteriorate and/or accumulate deposits. In an idealised engine 10 the relationship between turbine speed $N_H$ and turbine temperature TGT tracks up the line 48*b* so that the $N_H$ limit 44 and the TGT limit 46 are reached simultaneously. However, because transient effects can move the relationship to a parallel line, for example lines 48*a*, 48*c*, the relationship is shifted so that one of the limits 44, 46 is reached before the other. This may entail an earlier maintenance requirement than that scheduled according to the relationship line 48*b*.

The method seeks to sacrifice some turbine efficiency η in order to move the high pressure turbine 17 operation onto the line 48*b* so that both limits 44, 46 are reached approximately simultaneously. Since the turbine speed $N_H$ overshoot is greater than the turbine temperature TGT overshoot, when tightly controlling actual tip clearance 42, the turbine speed $N_H$ may be reduced at the expense of a small increase in turbine temperature TGT to move the relationship from line 48*c* to line 48*b*.

The method uses the tip clearance control system 80 to actively manage the turbine speed $N_H$ and turbine temperature TGT as well as the turbine efficiency q. Thus the method can choose to control to a non-optimal turbine efficiency η in order to reduce the turbine speed $N_H$. This may increase the turbine temperature TGT.

Figure 6:
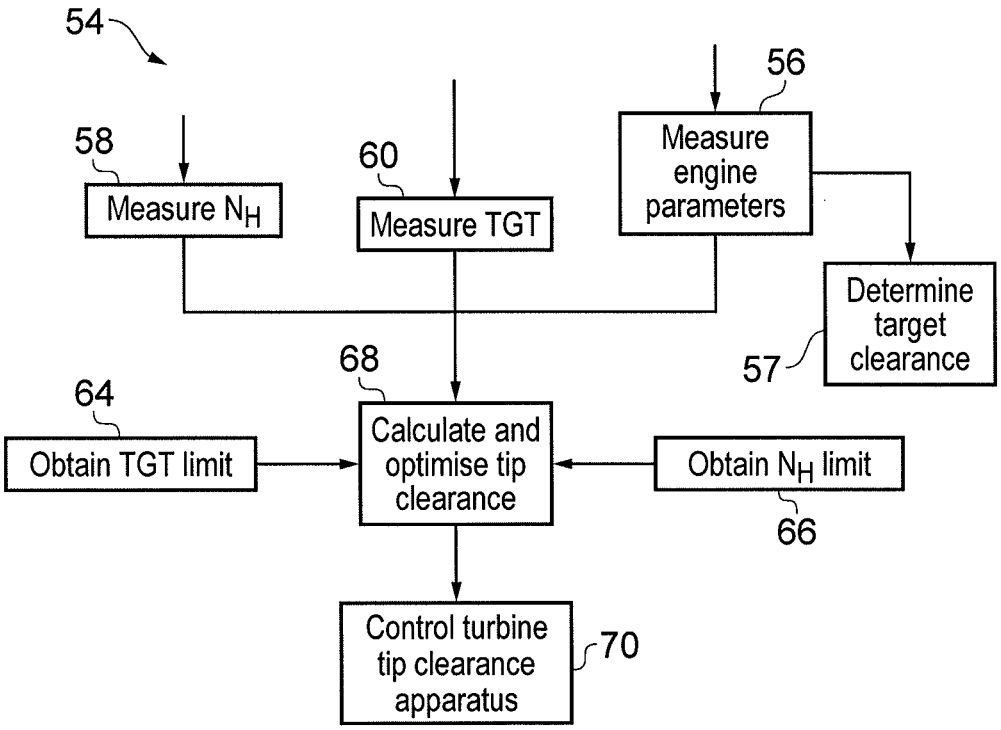
FIG. 6 is a flow chart of the method.

FIG. 6 illustrates the method 54 of controlling turbine tip clearance. There are several variables that must be obtained in order to control the turbine tip clearance 38. Firstly it is necessary to obtain, by measurement or otherwise, parameters that indicate engine 10 and flight conditions; box 56. Such parameters may include the engine power level, ambient temperature and pressure, the altitude of the aircraft, and indicators such as weight-on-wheels or other signals which are used to determine when the aircraft has left the ground. From these parameters 56 it is possible to derive a target tip clearance which the turbine tip clearance system 90 aims to deliver, box 57.

The method 54 also requires measurement of the turbine speed $N_H$, box 58. This may be obtained using any known method. For example, there may be a phonic wheel mounted to the high pressure shaft 23 with a sensor mounted to static structure close to it in order to record the time of arrival of each tooth and thence derive the rotational speed. Alternatively a sensor may be mounted radially outside the turbine blade tips 34 or compressor blade tips to record the times of arrival and thence derive the rotational speed. Alternatively the turbine speed $N_H$ may be measured via a gearbox mounted to be driven by, or to drive, the high pressure shaft 23. In this case a speed sensor or secondary PMA winding is provided in the gearbox to provide a speed measurement which is multiplied by the gear ratio between the gearbox and the high pressure shaft 23. Where the gearbox is mounted to a different shaft 24, 25 of the gas turbine engine 10 direct measurement of the shaft speed may be necessary.

The method 54 requires a measurement of the turbine temperature TGT, box 60. This may be obtained by direct measurement using a thermocouple or other suitable temperature probe. Alternatively, particularly where the operating temperature of the turbine is too high to be directly measured, the turbine temperature TGT may be derived from other engine parameters. Thus there may be an optional precursor step to measure, or otherwise obtain, the relevant engine parameters and to derive or calculate the turbine temperature therefrom.

The TGT limit 46 is obtained at box 64. Similarly the $N_H$ limit 44 is obtained at box 66. The limits 44, 46 may be stored in memory and retrieved therefrom.

The measured and/or calculated turbine speed $N_H$ and turbine temperature TGT may first be used to determine whether the high pressure turbine 17 is operating within the control area 52. The rest of the method 54 may be applied only if the operation is within the control area 52. Alternatively the method 54 may be applied for all take-off operations.

The turbine speed $N_H$ and turbine temperature TGT from boxes 58 and 60, the parameters from box 56 and the limits from boxes 64, 66 are all inputs to a function to calculate and optimise the turbine tip clearance; box 68. Finally the calculated and optimised turbine tip clearance is passed to the turbine tip clearance system 90 to control the turbine tip clearance apparatus, box 70.

Figure 7:
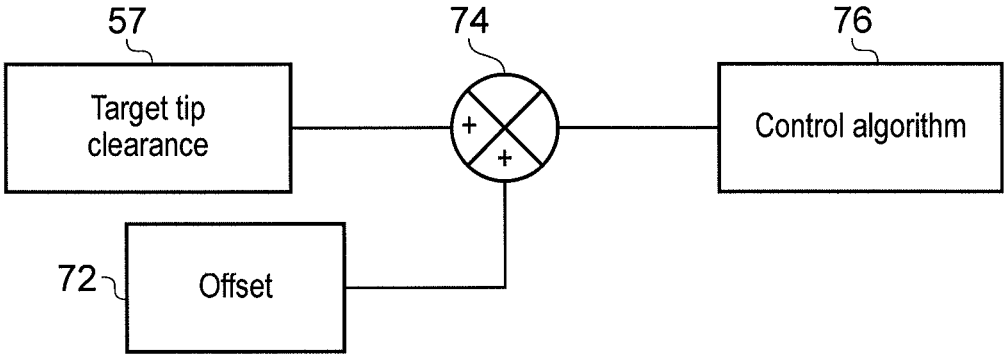
FIG. 7 is a flow chart of part of the method.
Figure 10:
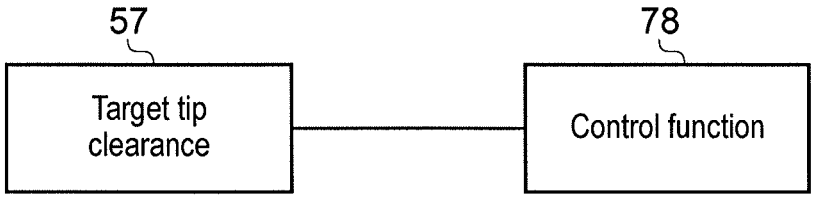
FIG. 10 is a flow chart of part of the method.

FIG. 7 and FIG. 10 show two ways in which to implement the function to calculate and optimise the turbine tip clearance. The function may comprise a simple look-up table or algorithm to provide an offset to the target tip clearance on the basis of the measured or derived turbine speed $N_H$ and turbine temperature TGT. This is shown as box 72 in FIG. 7. This offset calculation is simple to implement because it employs open loop control.

Figure 8:
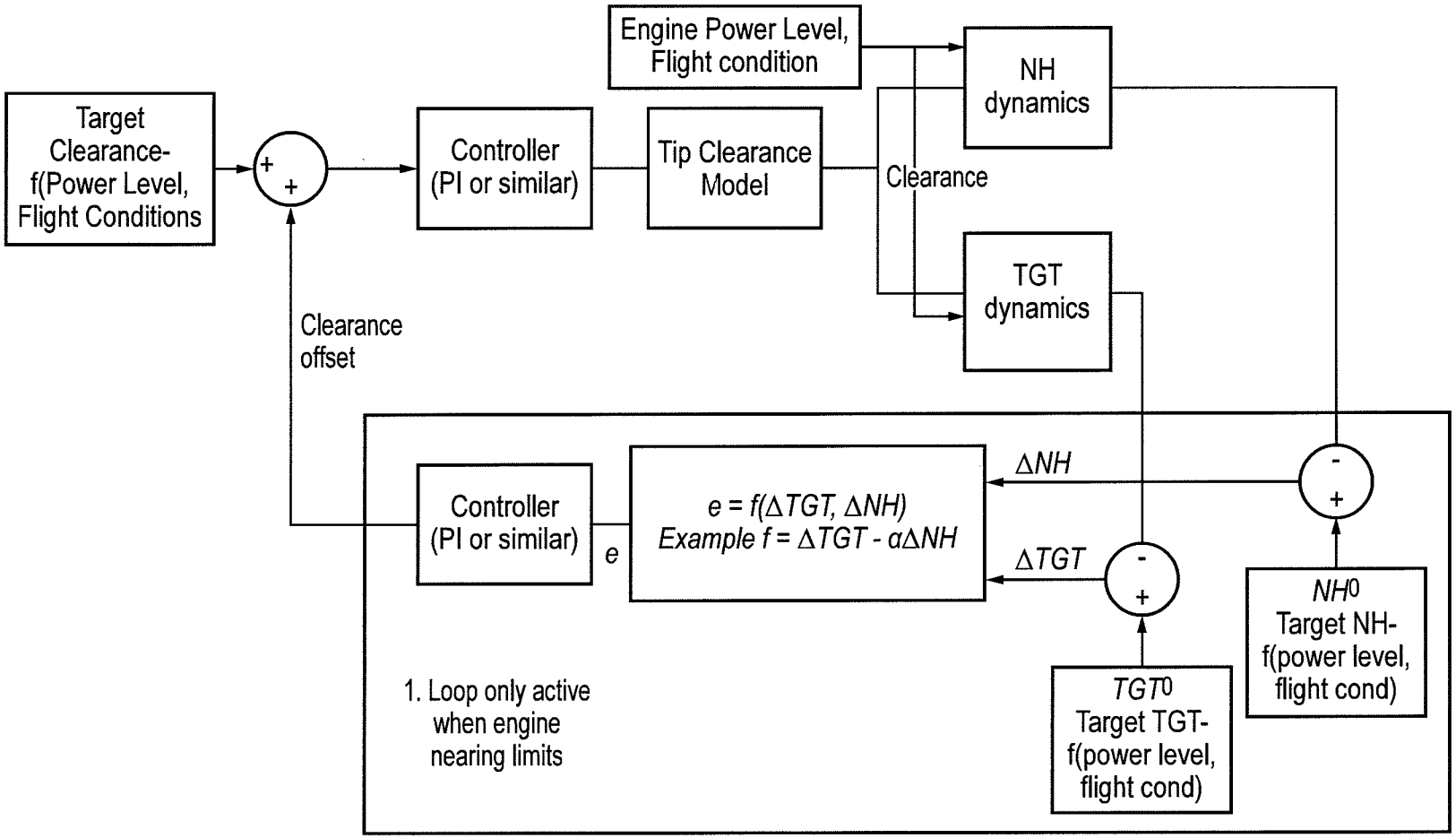
FIG. 8 and FIG. 9 are each control flow diagrams of clearance control.

Alternatively the offset, box 72, may be determined by inputting the turbine speed $N_H$ and turbine temperature TGT to a proportional-integral (PI) controller. An example of this type of controller is shown in FIG. 8. This is more accurate because it employs closed loop control of the tip clearance 38 by using the effect of changes to the tip clearance 38 to inform the new clearance calculation.

The offset, box 72, and target tip clearance, box 57, are added together in a summer 74 and the resulting clearance is outputted to a control algorithm 76 as shown in FIG. 7.

Figure 9:
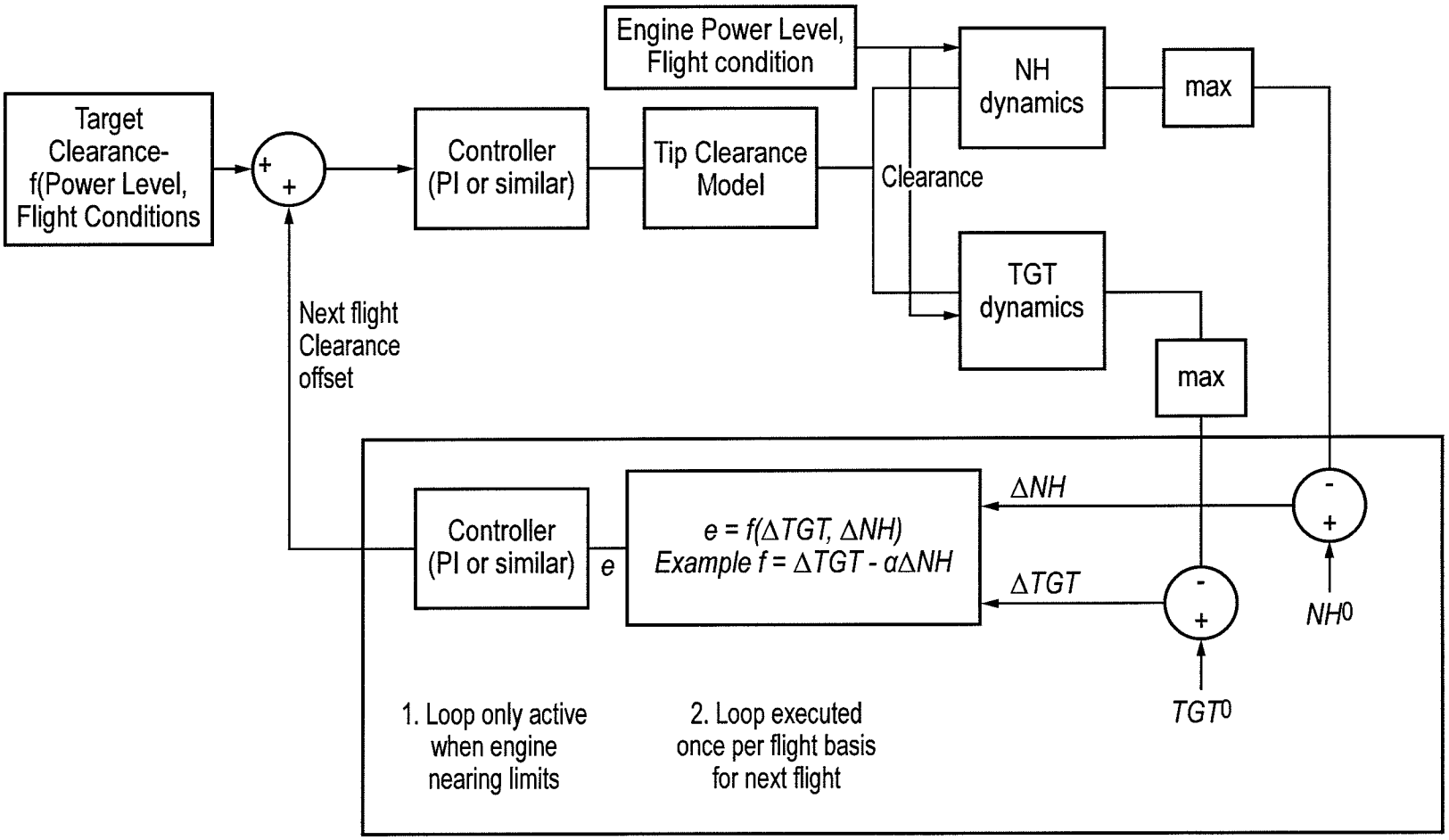

It may be beneficial to calculate the offset, box 72, only once per flight, or once per n flights where n>1 since deterioration affecting the offset changes over a number of operating cycles, and to use the calculated offset in the next flight. Thus the offset could be calculated using the peak turbine speed $N_{H_peak}$ and peak turbine temperature $TGT_{peak}$; that is the maximum values in a flight or cycle, or in a set of flights or cycles. An example of this type of controller is shown in FIG. 9. The clearance offset, box 72, is then predicated on the worse case tip clearance 38 from the previous flight or cycle. Advantageously calculating the offset only once per flight, or every n flights, ensures that the loop dynamics of the offset calculation do not adversely interact with the loop dynamics of the turbine tip clearance calculation. It also requires less processor power.

In FIG. 10 the target tip clearance, box 57, is passed to a more complex control function 78. This control function 78 calculates a suitable tip clearance control value by applying the target clearance, box 57, and the measured turbine speed $N_H$ and turbine temperature TGT to a model of the thermal and centrifugal load growths of all the turbine components. The model then outputs the current tip clearance 38, and may output a prediction of the tip clearance at a future time if no control air is applied to the turbine components. The model also outputs the required turbine tip clearance control to achieve the target clearance.

Whichever function is used to calculate the turbine tip clearance 38 also seeks to optimise the turbine efficiency q within the constraints of the $N_H$ and TGT limits. Thus the function may first seek a turbine tip clearance 38 which maximises the turbine efficiency q and then adjusts the turbine tip clearance 38 to ensure both turbine speed $N_H$ and turbine temperature TGT remain below their respective limits 44, 46 with the consequent reduction in turbine efficiency q. Alternatively the function may iteratively seek values of turbine tip clearance 38 that meets the constraints of the limits 44, 46 and the requirement to have good turbine efficiency q. In either case the aim is to optimise the tip clearance 38 for the best turbine efficiency q possible whilst meeting the TGT limit 46 and the $N_H$ limit 44 constraints. It is also the aim to reach the TGT limit 46 and the $N_H$ limit 44 approximately simultaneously. This can also be considered to be running out of margin for turbine temperature TGT and turbine speed $N_H$ simultaneously.

In other applications it may be desirable to seek to optimise the operational cost within the TGT and $N_H$ limits 46, 44. Such an optimisation may take account of the effect on life of the turbine components by increasing or decreasing the turbine temperature TGT and turbine speed $N_H$ relative to each other. Beneficially this may result in lower operating cost and/or longer intervals between engine maintenance actions because part life is improved.

The calculated and optimised tip clearance, box 68, is provided to control the turbine tip clearance apparatus, box 70 of FIG. 6. The turbine tip clearance apparatus is part of the turbine case cooling system 80.

Although a gas turbine engine 10 for powering an aircraft has been used to describe the features of the invention, the method and apparatus are applicable in other contexts. For example, the method can be applied to a marine gas turbine engine 10. The method can also be used in an industrial gas turbine engine 10, particularly one which is configured to supply peak power and therefore accelerates rapidly from stationary with the consequent rapid thermal and centrifugal growths affecting the turbine tip clearances 38.

Although the operation has been described in relation to acceleration during take-off of an aircraft, it is also applicable in other contexts. In particular the method may be applied whenever there is a large transient of the engine operation which requires the tip clearance 38 to be controlled in order to maintain efficient operation and to prevent tip rub. Such transient may be causes by a large power off-take, particularly an unscheduled power off-take. For example, in a military aircraft a large power off-take may be demanded to power a weapon mounted to the aircraft. In a marine gas turbine engine large power off-takes may also be demanded.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A method of controlling turbine tip clearance comprising steps to:

measure parameters indicative of current operating conditions including a turbine speed and a turbine temperature;

determine maximum permissible limits for the turbine speed and the turbine temperature;

calculate target tip clearance from the turbine speed, the turbine temperature and parameters, to optimise turbine efficiency within the turbine speed limit and the turbine temperature limit; and control turbine tip clearance apparatus to the calculated target tip clearance, wherein the turbine tip clearance is controlled only when the turbine speed and turbine temperature are within a predetermined amount of the turbine speed limit and the turbine temperature limit during take-off operations.

2. The method as claimed in claim 1, wherein the method is for controlling the turbine tip clearance of a gas turbine engine for an airplane in flight and the turbine speed is measured once per each flight of the airplane and comprises peak turbine speed.

3. The method as claimed in claim 1, wherein the method is for controlling the turbine tip clearance of a gas turbine engine for an airplane in flight and the turbine speed is measured once every predetermined number of flights of the airplane and comprises peak turbine speed.

4. The method as claimed in claim 1, wherein the method is for controlling the turbine tip clearance of a gas turbine engine for an airplane in flight and the turbine temperature is measured once per each flight of the airplane and comprises peak turbine temperature.

5. The method as claimed in claim 1, wherein the method is for controlling the turbine tip clearance of a gas turbine engine for an airplane in flight and the turbine temperature is measured once every predetermined number of flights of the airplane and comprises peak turbine temperature.

6. The method as claimed in claim 1, wherein the method is for controlling the turbine tip clearance of a gas turbine engine for an airplane in flight and the parameters comprise engine power level; flight condition.

7. The method as claimed in claim 1, wherein the step to calculate target tip clearance comprises using a proportional-integral algorithm.

8. The method as claimed in claim 1, wherein the step to calculate the target tip clearance comprises an input that is the difference between a current measured tip clearance and a previously calculated target tip clearance.

9. The method as claimed in claim 1, wherein the step to measure turbine temperature comprises measuring one or more engine parameters and deriving turbine temperature therefrom.

10. A turbine tip clearance system comprising:

one or more sensors to measure the parameters indicative of current operating conditions including the turbine speed and the turbine temperature;

a processor configured to receive measurements from the sensors; perform steps of the method according to claim 1; and to output a turbine tip clearance signal; and an actuator configured to receive the turbine tip clearance signal and to actuate the turbine tip clearance apparatus to change the tip clearance to match the calculated target tip clearance.

11. A turbine assembly comprising the turbine tip clearance system as claimed in claim 10.

12. A turbine tip clearance system comprising:

one or more sensors to measure the parameters indicative of current operating conditions including the turbine speed and the turbine temperature;

a processor configured to receive measurements from the sensors; perform steps of the method according to claim 2; and to output a turbine tip clearance signal; and an actuator configured to receive the turbine tip clearance signal and to actuate the turbine tip clearance apparatus to change the tip clearance to match the calculated target tip clearance.

13. A turbine tip clearance system comprising:

one or more sensors to measure the parameters indicative of current operating conditions including the turbine speed and the turbine temperature;

a processor configured to receive measurements from the sensors; perform steps of the method according to claim 3; and to output a turbine tip clearance signal; and an actuator configured to receive the turbine tip clearance signal and to actuate the turbine tip clearance apparatus to change the tip clearance to match the calculated target tip clearance.

14. A turbine tip clearance system comprising:

one or more sensors to measure the parameters indicative of current operating conditions including the turbine speed and the turbine temperature;

a processor configured to receive measurements from the sensors; perform steps of the method according to claim 4; and to output a turbine tip clearance signal; and an actuator configured to receive the turbine tip clearance signal and to actuate the turbine tip clearance apparatus to change the tip clearance to match the calculated target tip clearance.

15. A turbine tip clearance system comprising:

one or more sensors to measure the parameters indicative of current operating conditions including the turbine speed and the turbine temperature;

a processor configured to receive measurements from the sensors; perform steps of the method according to claim 5; and to output a turbine tip clearance signal; and an actuator configured to receive the turbine tip clearance signal and to actuate the turbine tip clearance apparatus to change the tip clearance to match the calculated target tip clearance.

16. A turbine tip clearance system comprising:

one or more sensors to measure the parameters indicative of current operating conditions including the turbine speed and the turbine temperature;

a processor configured to receive measurements from the sensors; perform steps of the method according to claim 6; and to output a turbine tip clearance signal; and an actuator configured to receive the turbine tip clearance signal and to actuate the turbine tip clearance apparatus to change the tip clearance to match the calculated target tip clearance.

17. A turbine tip clearance system comprising:

one or more sensors to measure the parameters indicative of current operating conditions including the turbine speed and the turbine temperature;

a processor configured to receive measurements from the sensors; perform steps of the method according to claim 7; and to output a turbine tip clearance signal; and an actuator configured to receive the turbine tip clearance signal and to actuate the turbine tip clearance apparatus to change the tip clearance to match the calculated target tip clearance.

18. A turbine tip clearance system comprising:

one or more sensors to measure the parameters indicative of current operating conditions including the turbine speed and the turbine temperature;

a processor configured to receive measurements from the sensors; perform steps of the method according to claim 8; and to output a turbine tip clearance signal; and an actuator configured to receive the turbine tip clearance signal and to actuate the turbine tip clearance apparatus to change the tip clearance to match the calculated target tip clearance.

19. A turbine tip clearance system comprising:

one or more sensors to measure the parameters indicative of current operating conditions including the turbine speed and the turbine temperature;

a processor configured to receive measurements from the sensors; perform steps of the method according to claim 9; and to output a turbine tip clearance signal; and an actuator configured to receive the turbine tip clearance signal and to actuate the turbine tip clearance apparatus to change the tip clearance to match the calculated target tip clearance.

20. The method as claimed in claim 1, wherein a turbine is controlled such that the determined maximum permissible limits for turbine speed and turbine temperature are reached simultaneously.

21. The method as claimed in claim 1, wherein the optimising of turbine efficiency is reducing turbine efficiency so that the turbine speed and the turbine temperature are within the turbine speed limit and the turbine temperature limit.

* * * * *